US005194776A

United States Patent [19]

Chevalier

[11] Patent Number: 5,194,776

[45] Date of Patent: Mar. 16, 1993

[54] ELECTRON BEAM DEFLECTOR WITH MAGNETIC CORRECTION FIELD AND INCORPORATED AUXILIARY MAGNETIC SHIELDING

[75] Inventor: Jacques Chevalier, Jarrie, France

[73] Assignee: Thomson Tubes Electroniques, Boulogne-Billancourt, France

[21] Appl. No.: 789,453

[22] Filed: Nov. 7, 1991

Related U.S. Application Data

[63] Continuation of Ser. No. 574,132, Aug. 29, 1990, abandoned.

[30] Foreign Application Priority Data

Sep. 12, 1989 [FR] France ..... 8911891

[51] Int. Cl.[5] ..... H01J 29/70

[52] U.S. Cl. ..... 313/431; 313/313; 313/402; 313/440; 335/214

[58] Field of Search ..... 313/402, 313, 431, 440; 315/85; 335/214

[56] References Cited

U.S. PATENT DOCUMENTS 2,769,115 8/1951 Callender ..... 313/479
4,556,821 12/1985 Cooper ..... 315/85
4,943,753 7/1990 Hevesi ..... 335/214

OTHER PUBLICATIONS

Patent Abstracts of Japan, vol. 11, No. 355 (E-558) [2802], Nov. 19, 1987; & JP-A-62 133 651 (Hitachi Ltd.) Jun. 16, 1987.

Patent Abstracts of Japan; vol. 4, No. 32 (E-2) [514], Mar. 19, 1980, pp. 58 E2; & JP-A-55 004 869 (Matsushita Denki Sangyo K.K.) Jan. 14, 1980.

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

An improved electron beam deflector with incorporated permanent magnets for picture correction, where the magnets and the magnetic field generated by these magnets are surrounded by an auxiliary magnetic shielding that forms one piece with the deflector and is positioned with high geometrical precision with respect to the magnets. This auxiliary shielding causes the picture correction efficiency to be unaffected by the shape and geometry of positioning of the metal elements in the vicinity of the deflector when it is being assembled and during its operation. The deflector can be used with picture tube devices, particularly of the cathode-ray type.

5 Claims, 1 Drawing Sheet

FIG_1-a PRIOR ART
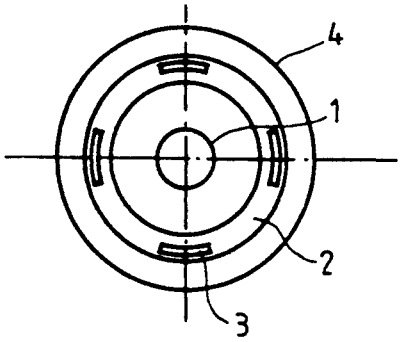
FIG_1-b PRIOR ART
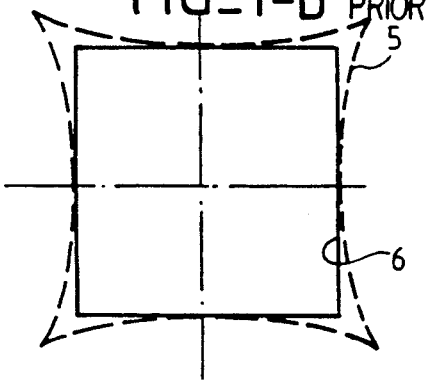
FIG_2-a PRIOR ART
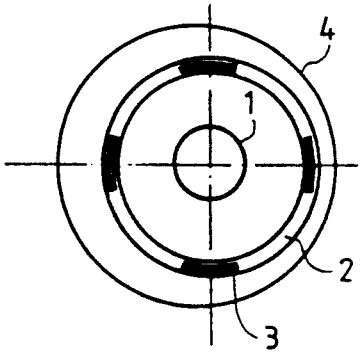
FIG_2-b PRIOR ART
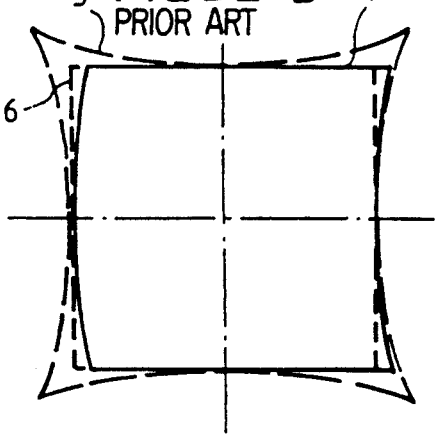
FIG_3
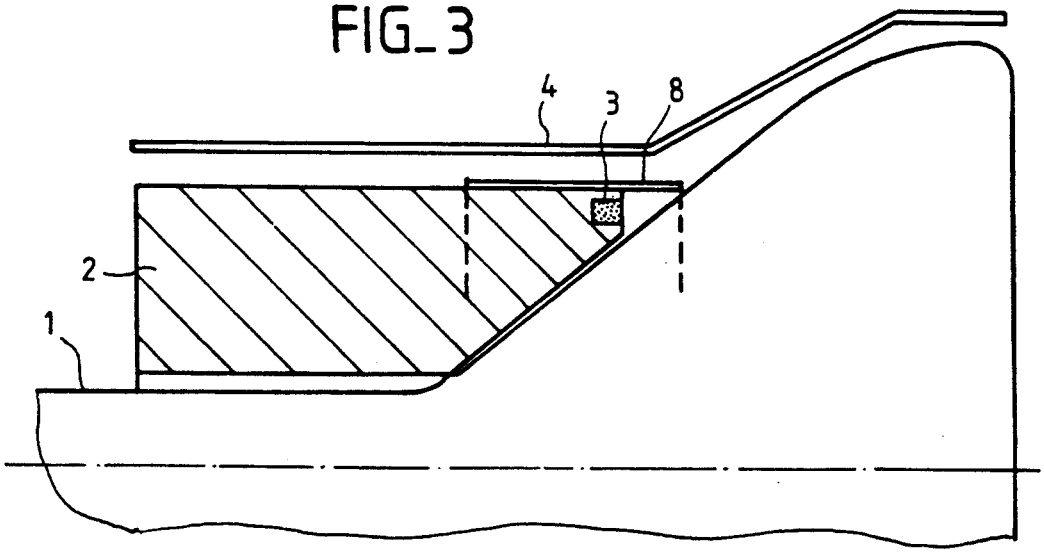

ELECTRON BEAM DEFLECTOR WITH MAGNETIC CORRECTION FIELD AND INCORPORATED AUXILIARY MAGNETIC SHIELDING

This application is a continuation of application Ser. No. 07/574,132, filed on Aug. 29, 1990, now abandoned.

BACKGROUND OF THE INVENTION

1. Field of the Invention

The present invention concerns electronic picture tubes and, more precisely, electron beam deflectors associated with these tubes.

Electron beam tubes concerned by this invention are electron beam tubes in which the deflection of the beam is used either to depict the picture on a display screen, in the case of cathode-ray tubes (CRTs), or to pick up the picture in the case of camera tubes.

2. Description of the Prior Art

It will be recalled that a CRT is formed by a vacuum chamber in which there is an electron gun to form an electron beam, and a display screen that emits light when it is struck by the beam. Means for modulating and deflecting said beam enable the picture to be depicted. These means may be located inside or outside the vacuum chamber.

The electron beam may be modulated or deflected by electromagnetic fields. Said means of deflection and modulation are therefore, generally, devices to create appropriate electromagnetic fields to obtain the desired picture While the modulation and electrostatic deflection are often obtained by means of electrodes taken to high voltages and placed within the tube, the electromagnetic deflection is generally obtained by means of magnets, electromagnets or coils mounted outside the tube.

The geometrical precision of the image depends on the precision of modulation or deflection obtained by the means used, and may be spoiled by stray electromagnetic fields coming from the environment of the tube when it is set up in a piece of equipment. For this reason, CRTs designed to work in complicated environments are generally surrounded by an electromagnetic shielding device designed to prevent the surrounding electromagnetic fields from penetrating the tube and thus avoid disturbances in the picture.

This electromagnetic shielding device may be a casing made of a material that is a good conductor of electricity and has high magnetic permeability. Electromagnetic shielding means such as this are commonly used for CRTs placed on board aircraft, tanks, ships or helicopters, for example.

In certain improved CRTs of the prior art, corrections are made to the geometry of the picture by means of electromagnetic fields given by permanent magnets. The tunings of these correction fields are done in the factory. These tuning operations consist in positioning the permanent magnets so as to obtain the desired picture geometry. To be effective under the operating conditions of the CRT, these tunings must be made under similar electromagnetic environmental conditions, namely the CRT should be surrounded by its electromagnetic shielding during these correction field tuning operations. This is because, as we know, the magnetic fields are disturbed by the metallic masses that surround them. Hence, the picture geometry correction obtained depends on the relative position of the magnets and of the shielding: this positioning becomes critical for the quality of the picture.

This point entails several drawbacks for the industrial scale manufacturing of the assemblies of shielded CRTs, among them the drawbacks indicated here below. Since the manufacture of CRTs comes rather within the field of glass technology while that of the shielding comes rather within the field of plate work, the tube manufacturer often entrusts the making of the latter to a subcontractor. The CRT manufacturer must have the shieldings available in order to make the correction tunings, and must therefore keep them in store. If a shielding of a different geometry is used, the correction field of the magnets has to be modified. A deflector designed for one shielding cannot be used for another shielding of a different shape. This means that the manufacturer has to manufacture different shieldings for each type of CRT, hence often for a large number of different CRTs. Also, there will be as many different deflectors as there are different CRTs and different shieldings.

If the deflector and the shielding are not perfectly aligned, the "shunt" effect of the electromagnetic field of the magnets due to the metal of the shielding is dissymmetrical, and this introduces a distortion into the picture.

The aim of the present invention is to overcome these drawbacks by proposing a deflector, with field correction by permanent magnets, that is sensitive neither to the shape nor to the relative geometry of assembly of the electromagnetic shielding.

The device according to the invention makes it possible to avoid the need for lengthy tuning operations in which additional magnets are added on as well as for tuning operations that are individually adapted to the shieldings. The device according to the invention enables the use of practically any geometry and shape of shielding and therefore enables a considerable reduction in the number of different deflectors used by a CRT manufacturer.

SUMMARY OF THE INVENTION

To achieve these ends, the invention proposes an electron beam deflector with magnetic field of correction provided by permanent magnets surrounded by an auxiliary electromagnetic shielding that forms one piece with said deflector, said shielding being assembled on the rim of said deflector and being mounted with high geometric precision with respect to the magnets.

The presence of this auxiliary shielding around the correction magnets according to the invention has the effect of isolating the fields generated by these magnets from any disturbance external to the deflector, and notably from the influence of the main electromagnetic shielding the CRT, due to the geometry of its shape or its positioning.

A very substantial saving in assembling times and in the number of replacement parts (deflectors, auxiliary magnets etc.) to be used is thus obtained.

BRIEF DESCRIPTION OF THE DRAWINGS

Other characteristic objects and results of the invention shall appear from the following description, given as a non-restrictive example and illustrated by the appended figures, of which:

FIG. 1*a* shows a sectional view of the assembly formed by the main shielding of the CRT, the beam deflector (with the incorporated permanent magnets for picture correction) and the vacuum chamber of the CRT in a symmetrical arrangement according to the prior art, with a schematic view of the resultant correction, in FIG. 1*b*;

FIG. 2*a* shows a sectional view of the assembly formed by the main shielding , the deflector (with the incorporated permanent magnets for picture correction) and the vacuum chamber of the CRT according to the prior art in a slightly dissymmetrical arrangement, with a schematic view of the resultant (defective) correction, in FIG. 2*b*;

FIG. 3 shows a schematic longitudinal sectional view of the assembly formed by the main shielding of the CRT and the deflector according to the invention with its incorporated permanent magnets for correction and its auxiliary electromagnetic shielding according to the invention, positioned around a bare CRT.

In the different figures, the same references are repeated for the same elements but, for reasons of clarity, the dimensions and proportions of the various elements have not been kept to.

DESCRIPTION OF PREFERRED EMBODIMENTS

FIG. 1*a* shows a schematic sectional view of an assembly formed by the main shielding (4) of the CRT, a beam deflector (2) with its incorporated permanent magnets (3) for picture correction and the vacuum chamber (1) of the CRT according to the prior art in a symmetrical (and therefore concentric) arrangement. This represents the ideal configuration because it is the simplest one for giving a satisfactory correction, as shown in FIG. 1*b*.

FIG. 1*a* shows the main circular-sectioned shielding (4) of the CRT positioned concentrically around the deflector (2) which is also of circular section. The deflector (2) has permanent magnets (3) for picture correction arranged symmetrically around the same geometrical center as the shielding (4) and the deflector (2). Within the deflector (2) and concentrically with it, there is the vacuum chamber (1).

In FIG. 1*b*, dashed lines (5) show the uncorrected picture of the CRT and solid lines (6) show the picture corrected by the symmetrical system seen in a sectional view in FIG. 1*a*. The uncorrected picture is not rectangular as it should be but, on the contrary, has the appearance of a "cushion": it is slightly narrowed in the middle of its four sides and pointed at the four corners. The picture (6) corrected by means of the correction magnets (3) which are perfectly positioned with respect to the shielding (4) is quite square-shaped as shown by the solid line (6).

FIG. 2 is identical to FIG. 1 except for one difference: the geometry is not perfectly symmetrical. In FIG. 2*a*, it is seen that the main shielding (4) of the CRT is not concentric with the deflector assembly (2), the permanent magnets (3) for correction and the vacuum chamber (1). Hence, the right-hand magnet is closer to the shielding than the left-hand magnet. This could be the result of a manufacturing defect.

In FIG. 2*b*, dashed lines show the uncorrected picture (5) and the desired corrected picture (6) as shown in FIG. 1*b*, and solid lines (7) show the badly corrected picture resulting from the dissymmetry of the assembly as shown in FIG. 2*a*. In the specific example shown in FIG. 2, the symmetry is preserved around the horizontal median plane (which contains the axis of the CRT); and it is seen that the resulting picture correction remains satisfactory for the horizontal lines of the picture which are quite rectilinear. By contrast, the vertical lines are curved by the right-hand/left-hand dissymmetry of the correction geometry.

The dissymmetry of the example of FIG. 2 is one of the simplest imaginable. In all likelihood, the dissymmetry that could be introduced by the random factors entailed in large-scale industrial manufacture would be far more complicated. It is easy to see how critical the assembling precision becomes for ensuring the rectilinear geometry of the picture.

It is an aim of the invention to make this part of the assembling process less critical, and hence to make it easier to obtain improved image correction in industrial-scale manufacturing.

FIG. 3 gives a sectional view of an example of the system according to the invention, showing the same elements arranged in a geometry similar to that of FIG. 1, except for an auxiliary shielding, made of a material with high magnetic permeability (mu-metal, ferrite, etc.) (8) fixed around the deflector and, more particularly, around its incorporated, picture-correcting permanent magnets (3), and positioned with high precision with respect to these magnets.

The assembling precision of the assembly formed by the CRT(1), deflector (2) and shielding (4) becomes less critical for the image correction when the assembling precision of the assembly formed by the deflector (2), permanent magnets (3) and auxiliary shielding (8) is satisfactory, for the magnetic field lines due to these permanent magnets (3) are imprisoned within the auxiliary shielding (8) and therefore remain insensitive to what happens outside this auxiliary shielding.

In particular, not only does the position of the main shielding (4) become not critical, but also, its shape has no influence on the magnetic fields of correction which are isolated within their auxiliary shielding (8).

The result thereof is a very appreciable saving in assembling times. A saving in the number of deflectors to be used may also be obtained.

What is claimed is:

1. An electron beam deflector for use in a CRT device having picture correction capability comprising:
   - a main shielding surrounding said deflector;
   - permanent magnets disposed within said deflector for providing picture correction;
   - means for isolating magnetic fields generated by said permanent magnets from influences external to said deflector caused by the interaction of said magnetic fields with said main shielding surrounding said deflector,
   - wherein said means for isolating magnetic fields forms one piece with said deflector, and is assembled on a surface of said deflector, between said permanent magnets and said main shielding, and positioned with high geometrical precision with respect to said permanent magnets.

2. The electron beam deflector according to claim 1, wherein said means for isolating magnetic fields eliminates the influence of said main shielding on said magnetic fields generated by said permanent magnets thereby simplifying tuning of said permanent magnets.

3. The electron beam deflector according to claim 1, wherein said means for isolating said magnetic fields generated by said permanent magnets comprises an auxiliary magnetic shielding.

4. An electron tube including an electron beam deflector according to claim 1, wherein said electron tube is a cathode-ray tube.

5. An electron tube including an electron beam deflector according to claim 1, wherein said electron tube is an image pick-up tube.

* * * * *